US009262930B2

(12) United States Patent
De Prins

(10) Patent No.: US 9,262,930 B2
(45) Date of Patent: Feb. 16, 2016

(54) ARRIVAL TRAFFIC SCHEDULING SYSTEM INCORPORATING EQUIPAGE-DEPENDENT IN-TRIAL SPACING

(71) Applicant: The Boeing Company, Chicago, IL (US)

(72) Inventor: Johan De Prins, Heverlee (BE)

(73) Assignee: The Boeing Company, Chicago, IL (US)

( * ) Notice: Subject to any disclaimer, the term of this patent is extended or adjusted under 35 U.S.C. 154(b) by 17 days.

(21) Appl. No.: 14/217,804

(22) Filed: Mar. 18, 2014

(65) Prior Publication Data

US 2015/0269846 A1 Sep. 24, 2015

(51) Int. Cl.
*G08G 5/00* (2006.01)
*G08G 5/02* (2006.01)

(52) U.S. Cl.
CPC ..... *G08G 5/0043* (2013.01); *G08G 5/0082* (2013.01); *G08G 5/025* (2013.01)

(58) Field of Classification Search
None
See application file for complete search history.

(56) References Cited

U.S. PATENT DOCUMENTS

| | | | | |
|---|---|---|---|---|
| 8,566,012 | B1 | 10/2013 | Shafaat et al. | |
| 2003/0139875 | A1* | 7/2003 | Baiada et al. | 701/120 |
| 2008/0103647 | A1* | 5/2008 | Lucas et al. | 701/16 |
| 2010/0217461 | A1 | 8/2010 | Ledesma et al. | |
| 2010/0282916 | A1 | 11/2010 | Garrido-Lopez et al. | |
| 2012/0053760 | A1 | 3/2012 | Burnside et al. | |
| 2012/0245835 | A1* | 9/2012 | Weitz et al. | 701/120 |
| 2013/0261945 | A1 | 10/2013 | Marcy et al. | |
| 2014/0019033 | A1 | 1/2014 | Berge | |

* cited by examiner

*Primary Examiner* — Rami Khatib
(74) *Attorney, Agent, or Firm* — Ostrager Chong Flaherty & Broitman P.C.

(57) ABSTRACT

Systems and methods for generating arrival traffic schedules incorporating equipage-dependent in-trail spacing (time or distance). An arrival management system has a ground-based scheduling tool that applies customized spacing buffers between in-trail aircraft depending on the types of FMS equipage onboard aircraft sequence pairs.

20 Claims, 8 Drawing Sheets

ARRIVAL TRAFFIC SCHEDULING SYSTEM INCORPORATING EQUIPAGE-DEPENDENT IN-TRIAL SPACING

BACKGROUND

This disclosure generally relates to systems and methods for generating air traffic arrival schedules.

The Next Generation Air Transportation System (NextGen) and Single European Sky ATM Research (SESAR) programs seek to implement a trajectory-based operations concept that requires substantial changes to the current air traffic management (ATM) system, in both equipment and procedures. It is expected that required airplane capabilities for trajectory-based operations will include four-dimensional (4-D) trajectory execution with lateral and vertical navigation performance bounds, as well as navigation to a required or controlled time of arrival (CTA) at one or more points in space, and/or airplane traffic situation awareness with interval management applications. Limitations to the deviations of these 4-D trajectories will be required in order to avoid conflicts between merging, in-trail and crossing traffic. Additionally, due to traffic growth, airport throughput will have to be improved so arrival time accuracy will become more stringent. At the same time, the improved predictability of trajectory-based operations should reduce fuel consumption and the environmental impact by planning Continuous Descent Operations (CDOs) as much as possible with minimal tactical interventions to solve conflicts.

It is envisioned that NextGen and SESAR air traffic management (ATM) systems will enable aircraft to be at much closer longitudinal/lateral spacings in all phases of flight in controlled and uncontrolled airspace to increase airspace capacity and efficiency. These new airspace environments will be enabled by Automatic Dependent Surveillance-Broadcast (ADS-B) technology along with other technologies. ADS-B enhances safety by enabling display of traffic positions and other data, in real-time, to Air Traffic Control (ATC) and to other appropriately equipped ADS-B aircraft with position and velocity data transmitted every second. The ADS-B system relies on two avionics components—a high-integrity GPS navigation source and a data link (ADS-B unit) connected to other aircraft systems. ADS-B enables a pilot to display traffic information for surrounding aircraft, including the identification, position, altitude, heading and groundspeed of those aircraft. However, not all aircraft are equipped with an ADS-B system.

With the introduction of new ATM systems, the flight crew will be given responsibility for achieving and maintaining spacing behind other aircraft for higher airspace efficiency and capacity in all phases of flight. To achieve higher airspace efficiency and capacity, ATC operations will work to decrease spacing and also maintain consistent spacing between all ADS-B-capable aircraft. One of the procedures that will be utilized in achieving this goal will allow the air traffic controller to provide instructions to the flight crew to position their aircraft (hereinafter "trailing aircraft") behind a preceding aircraft (hereinafter "leading aircraft") at a specified longitudinal spacing interval defined in either time or distance. Once the clearance has been accepted, it will be the trailing aircraft flight crew's responsibility to achieve and then maintain the specified spacing value behind the leading aircraft as instructed by the controller.

The main arrival operations concept proposed for NextGen encompasses strategic optimization of the traffic flow using ground automation capabilities prototyped by NASA, namely, Traffic Management Advisor and Efficient Descent Advisor. Traffic Management Advisor (TMA) is the traffic scheduling and sequencing tool in charge of building conflict-free arrival sequences at runways and at a set of predefined metering fixes (i.e., a fix along an established route from over which aircraft will be metered prior to entering terminal airspace). The latter are typically located at the entry of the terminal area, such as in Terminal Radar Approach Control (TRACON) facilities. Efficient Descent Advisor (EDA) is the meet-time advisory tool that issues speed and path instructions to aircraft to meet the scheduled arrival time at the metering fixes set by the TMA. For independent arrival-departure operations, the scheduled inter-arrival time at the runway (or final approach fix) is typically based on wake-vortex criteria and weather conditions, resulting in fixed spacing (in distance or time) per pair of aircraft category types. At the metering fix, the planned spacing gap is typically based on a fixed miles-in-trail criterion independent of the trailing aircraft types.

On the airborne side, most commercial aircraft are equipped with Flight Management Systems (FMS) that offer automated vertical navigation (VNAV) with different modes. In descent, aircraft typically fly VNAV PATH, a mode where the aircraft uses a path-on-elevator method to track the vertical reference profile while throttles typically remain idle. From an energy point of view (assuming the aircraft mass is accurate), the aircraft is tracking the reference potential energy while the engines keep the reference idle power. According to the principle of energy conservation, any unexpected energy deviations (for example, wind energy prediction errors) will affect the kinetic energy. Hence the groundspeed of the aircraft changes, resulting in deviations in the position of the aircraft over time. More advanced guidance methods, like the Required Time of Arrival (RTA) method, combine VNAV PATH with path recalculations in order to meet a target time at a given waypoint. Other 4-D guidance methods track the groundspeed reference with the elevator pushing all errors into the vertical profile. For example, the supplemented Continuous Descent Approaches for Maximum Predictability (CDA-MP) guidance technique is an automated version of the manual crew-in-the-loop version disclosed by Garrido-Lopez et al. in "Analysis of Aircraft Descent Predictability: Implications for Continuous Four-Dimensional Navigation," AIAA Guidance, Navigation, and Control Conference, AIAA 2011-6217, Portland, Oreg. (2011), which features periodic speed adjustments to maintain the continuous 4-D tracking. Some guidance methods apply energy corrections through some use of the spoilers and throttles, or the timing of the aircraft landing configuration. Alternatively to the above-mentioned absolute time-based guidance methods, relative (time-based) guidance techniques are being developed that manage the aircraft's own position relative to a leading aircraft. An example of such a Flight deck Interval Management (FIM) system is the Airborne Spacing for Terminal Arrival Routes (ASTAR) system developed by NASA. Besides the various FMS guidance logics, also other factors influence the 4-D trajectory confinement in time and space, like the accuracy of the wind prediction, which may vary per FMS type and per airline.

Arrival management systems, like TMA, have been deployed at various airports over the world. These existing systems sequence flights to the runways and a set of metering fixes with the goal of predicting the optimal sequence in order to maximize runway throughput. The resulting arrival schedule is used by air traffic controllers today primarily as a guideline. The addition of strategic intent advisory tools like EDA (and others around the world) to the arrival management concept is currently still in a prototyping and validation phase. Adding spacing buffers into the scheduling algorithm has been proposed in research, but only fixed spacing buffers independent of the FMS equipage type and arrival demand have been evaluated so far. In today's operations without the advanced ground automation systems or advanced 4-D FMS guidance, CDOs have been implemented in some airports using customized arrival procedure design and an optimal inter-aircraft spacing target at the beginning of the arrival procedure as an advisory for the air traffic controllers to condition the traffic. This optimal initial spacing was determined offline with a Monte Carlo simulation for different levels of CDO success rate and per specific pair of trailing aircraft types. Hence these spacing buffers are based on differences in aircraft type performance rather than FMS guidance equipage. This method works satisfactory for trailing aircraft flying the same or similar routes, but is more difficult to be applied to arrival routes merging from different arrival directions. The latter requires ground automation to be in place.

The global operational aircraft fleet has a mix of aircraft guidance capabilities and with that comes variability in achievable arrival time accuracies. There is a need for improved means and methods for scheduling arrival traffic at airports which take into account the different FMS equipage onboard different types of aircraft.

SUMMARY

The subject matter disclosed herein is directed to systems and methods for generating arrival traffic schedules incorporating equipage-dependent in-trail spacing (time or distance). In accordance with the embodiments disclosed herein, an arrival management system has a ground-based scheduling tool that applies customized spacing buffers between in-trail aircraft depending on the types of FMS equipage onboard aircraft sequence pairs. These spacing buffers should enable maximizing the benefits of flying uninterrupted Continuous Descent Operations, i.e., fuel consumption and environmental impact, while accounting for maintaining a minimum required arrival throughput and limiting flight delays. Spacing buffers are introduced at the metering fixes and runways that take into account the temporal delivery performance of various FMS guidance methods present in the aircraft fleet. Different methods are disclosed in detail below for dynamically downsizing these buffers in order to fulfill a desired throughput and demand rate.

One aspect of the subject matter disclosed in detail below is a method for scheduling arrivals of aircraft at a fixed position comprising: obtaining first and second controlled times of arrival for first and second aircraft approaching the fixed position, the first and second controlled times of arrival being separated by a separation time; calculating a first spacing buffer time which is dependent on the types of guidance equipage onboard the first and second aircraft; and calculating an updated second controlled time of arrival for the second aircraft. The updated second controlled time of arrival is calculated by adding the separation time and the first spacing buffer time to the first controlled time of arrival. The method may further comprise transmitting an instruction to the second aircraft that includes the updated second controlled time of arrival. Additionally or alternatively, the method may further comprise: obtaining a third controlled time of arrival for a third aircraft approaching the fixed position, the third controlled time of arrival being separated from the second controlled time of arrival by the separation time; calculating a second spacing buffer time which is dependent on the types of guidance equipage onboard the second and third aircraft; calculating an updated third controlled time of arrival for the third aircraft, wherein the updated third controlled time of arrival is calculated by adding the separation time and the second spacing buffer time to the updated second controlled time of arrival.

Another aspect of the disclosed subject matter is a system for scheduling arrivals of aircraft at a fixed position comprising a computer system programmed to perform the operations described in the preceding paragraph (excluding instruction transmission).

A further aspect of the subject matter disclosed in detail below is a method for scheduling arrivals of aircraft at a fixed position comprising: obtaining first, second and third controlled times of arrival for first, second and third aircraft approaching the fixed position, the first and second controlled times of arrival being separated by a separation time, and the second and third controlled times of arrival being separated by the separation time; calculating a first spacing buffer time which is dependent on the types of guidance equipage onboard the first and second aircraft; calculating an updated second controlled time of arrival for the second aircraft; calculating a second spacing buffer time which is dependent on the types of guidance equipage onboard the second and third aircraft; reducing the second spacing buffer time to produce a reduced second spacing buffer; and calculating an updated third controlled time of arrival for the third aircraft. The updated third controlled time of arrival is calculated by adding the separation time and the reduced second spacing buffer time to the updated second controlled time of arrival. In accordance with some embodiments, the first buffer time is not reduced. In accordance with other embodiments, the method further comprises reducing the first spacing buffer time to produce a reduced first spacing buffer, wherein the updated second controlled time of arrival is calculated by adding the separation time and the reduced first spacing buffer time to the first controlled time of arrival. Preferably the first and second buffer times are reduced by the same proportion. The method may further comprise: transmitting an instruction to the second aircraft that includes the updated second controlled time of arrival; and transmitting an instruction to the third aircraft that includes the updated third controlled time of arrival.

Yet another aspect of the disclosed subject matter is a system for scheduling arrivals of aircraft at a fixed position comprising a computer system programmed to perform the operations described in the preceding paragraph (excluding instruction transmission).

Other aspects of systems and methods for generating arrival traffic schedules incorporating equipage-dependent in-trail spacing are disclosed below.

BRIEF DESCRIPTION OF THE DRAWINGS

Reference will hereinafter be made to the drawings in which similar elements in different drawings bear the same reference numerals.

DETAILED DESCRIPTION

The following detailed description is illustrative in nature and not intended to limit claim coverage to the disclosed embodiments or the disclosed applications and uses of the disclosed embodiments.

Figure 1:
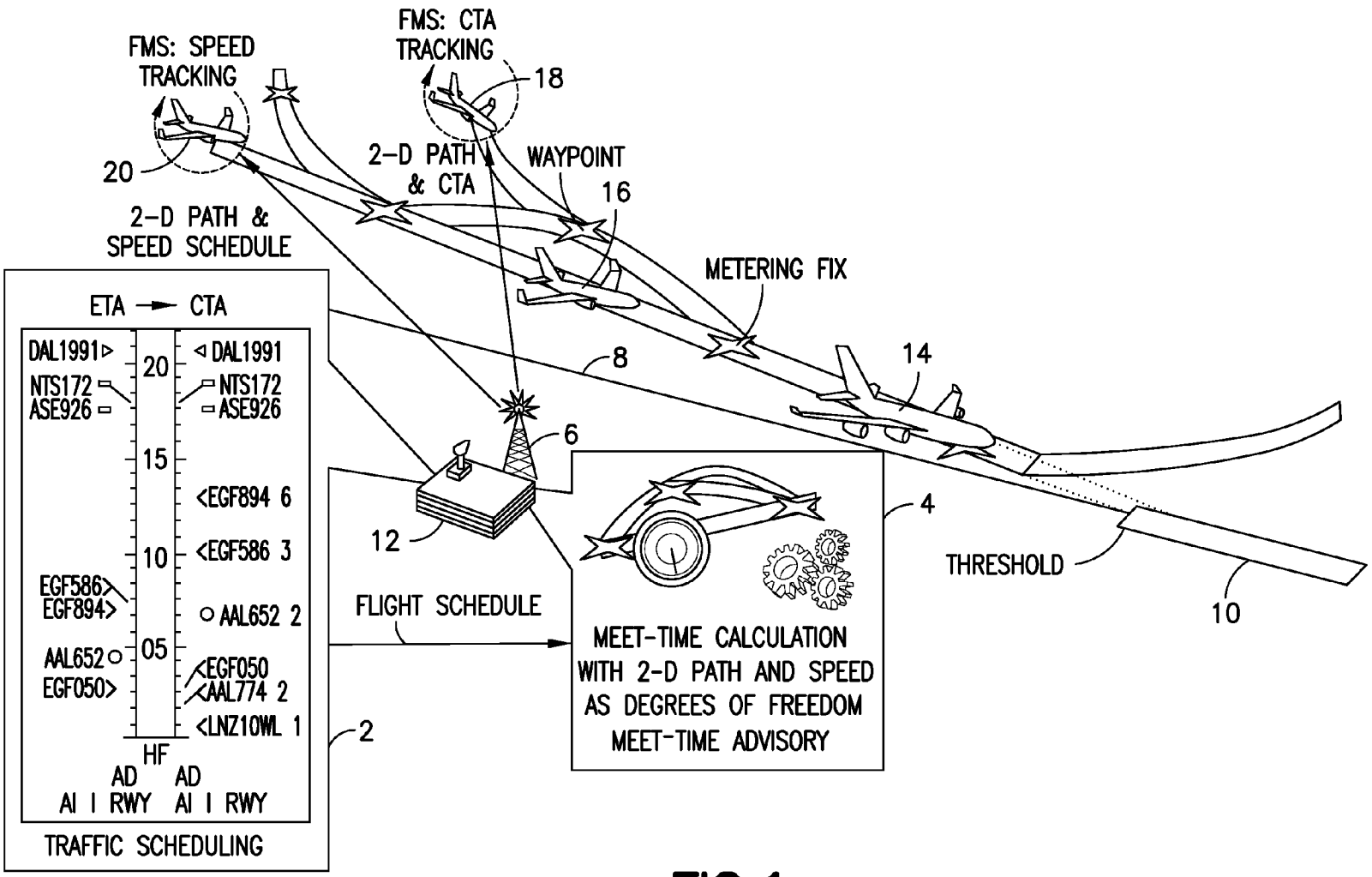
FIG. 1 is a diagram showing aspects of a strategic arrival management process involving traffic scheduling and meet-time advisory generation.

FIG. 1 is a diagram showing aspects of a strategic arrival management process involving traffic scheduling and meet-time advisory generation. The bands represent flight paths; the four-pointed stars represent respective waypoints, except for the rightmost four-pointed star, which represents a metering fix.

A traffic scheduling and sequencing tool 2 (e.g., TMA) is in charge of building conflict-free arrival sequences at a threshold of a runway 10 (having a centerline 8) and at a metering fix (indicated by a four-pointed star in FIG. 1). The traffic scheduling and sequencing tool 2 sequences flights to the threshold of the runway 10 and the metering fix, converting estimated times of arrival (ETA) into controlled times of arrival (CTA), with the goal of predicting the optimal sequence in order to maximize runway throughput. A meet-time advisory tool 4 (e.g., EDA) issues speed and path instructions to meet the scheduled arrival time at the metering fix set by the traffic scheduling and sequencing tool 2 and contained in the flight schedule sent to the meet-time advisory tool 4. For aircraft equipped with 4-D guidance functions (e.g. RTA), the meet-time advisory tool 4 can directly issue the CTA in combination with the path instruction.

The traffic scheduling and sequencing tool 2 and the meet-time advisory tool 4 are respective software modules running on a computer system 12, which may comprise one or more computers or processors that communicate through a network or bus. In the scenario depicted in FIG. 1, the speed and path instructions issued by the meet-time advisory tool 4 are transmitted by an antenna 6 of a ground-to-air communications system to a plurality of aircraft 14, 16, 18, 20 which are approaching the threshold of runway 10. (For the purpose of illustration, the ground-to-air communications system is treated as part of the computer system 12 and is not depicted in FIG. 1 as a separate component. Any known ground-to-aircraft communications systems can be used.)

Fast-time simulation experiments were conducted using a traffic simulation capability that emphasized FMS equipage type and accurate trajectory modeling. The operational performance of the concept was evaluated for a representative traffic scenario for Atlanta International Airport. The results of that simulation are reported by De Prins et al. in a paper entitled "Time-Based Arrival Management Concept with Mixed FMS Equipage" and presented at the 32$^{nd}$ Digital Avionics Systems Conference, Syracuse, N.Y., Oct. 6-10, 2013, IEEE/AIAA, the contents of which are incorporated by reference herein in their entirety.

Figure 2:
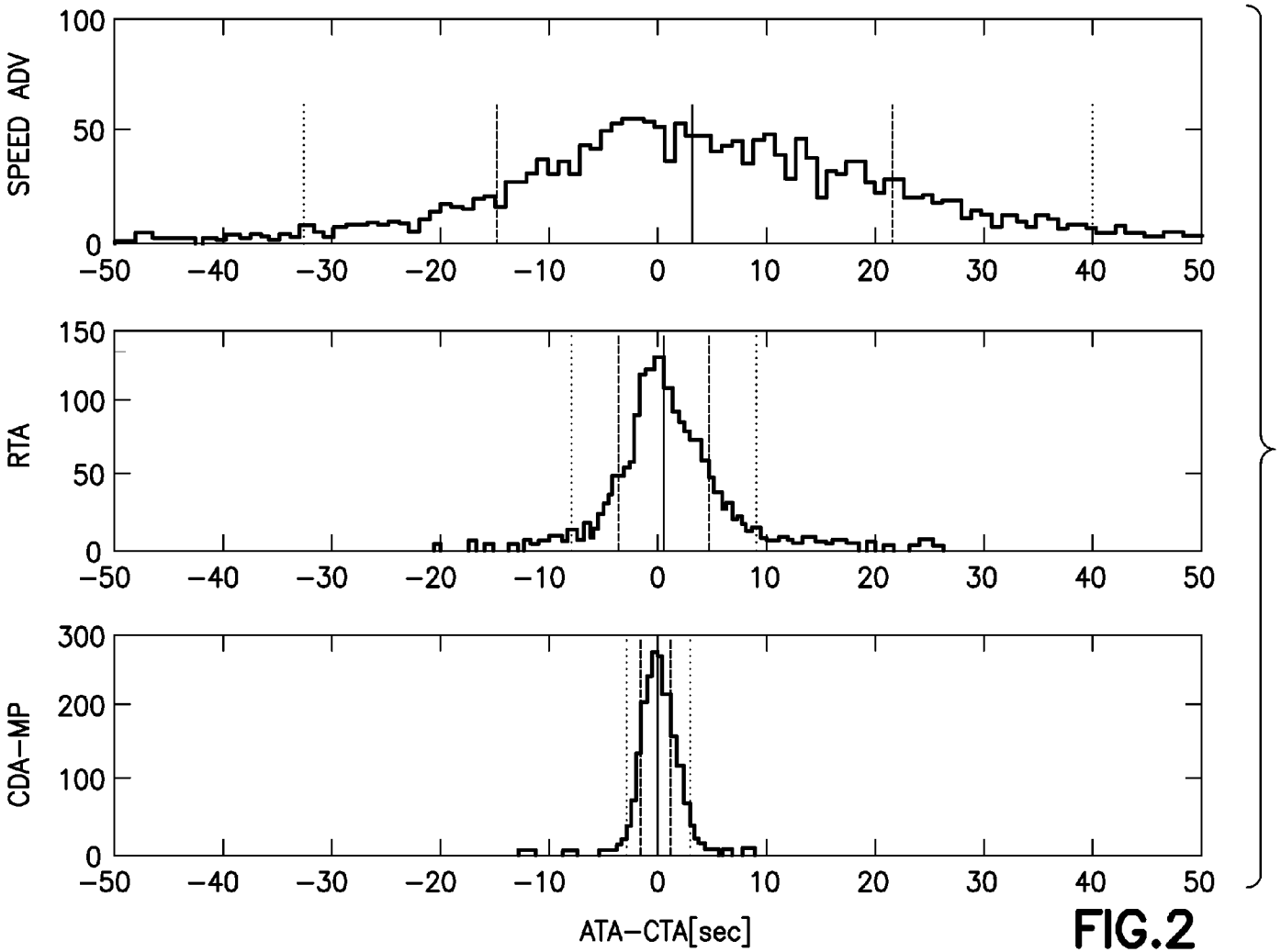
FIG. 2 is a set of histograms showing simulated temporal delivery accuracy at a metering fix for three types of FMS equipage.

FIG. 2 is a set of histograms (taken from the aforementioned De Prins et al. paper) showing simulated temporal delivery accuracy at a metering fix for three types of FMS equipage. More specifically, FIG. 2 illustrates the arrival time accuracy at a metering fix for speed-advised VNAV PATH flights (top histogram), RTA flights (middle histogram) and a groundspeed-based 4-D guidance (CDA-MP; bottom histogram) from the simulation experiments. This accuracy is measured as the difference between the Actual Time of Arrival (ATA) and the scheduled or Controlled Time of Arrival (CTA) set by the ground automation. The performance of the three FMS equipage types was evaluated in five real-world time-varying weather conditions in the proposed operational environment (totaling 1880 flights per method). All delay was allocated to the metering fixes and no buffers were applied. Taking into account the modeling assumptions, the time confinement results were rounded to the second. As expected, aircraft using speed-advised VNAV PATH guidance cannot compete with the 4-D guidance methods: 95th percentile of the traffic arrived within 41 sec of the set CTA as compare to 9 sec for RTA and 4 sec for CDA-MP.

By introducing FMS equipage-dependent spacing buffers on top of the minimum separation criteria in the scheduling process, one can maximize the probability of completing uninterrupted CDOs irrespective of the FMS equipage mix while maintaining a desired arrival throughput. As disclosed in detail below, spacing buffers can be introduced at metering fixes and runway thresholds that take into account the temporal delivery performance of various FMS guidance methods present in the aircraft fleet. Different methods are proposed for dynamically downsizing these buffers in order to fulfill a desired throughput and demand rate.

Figure 3:
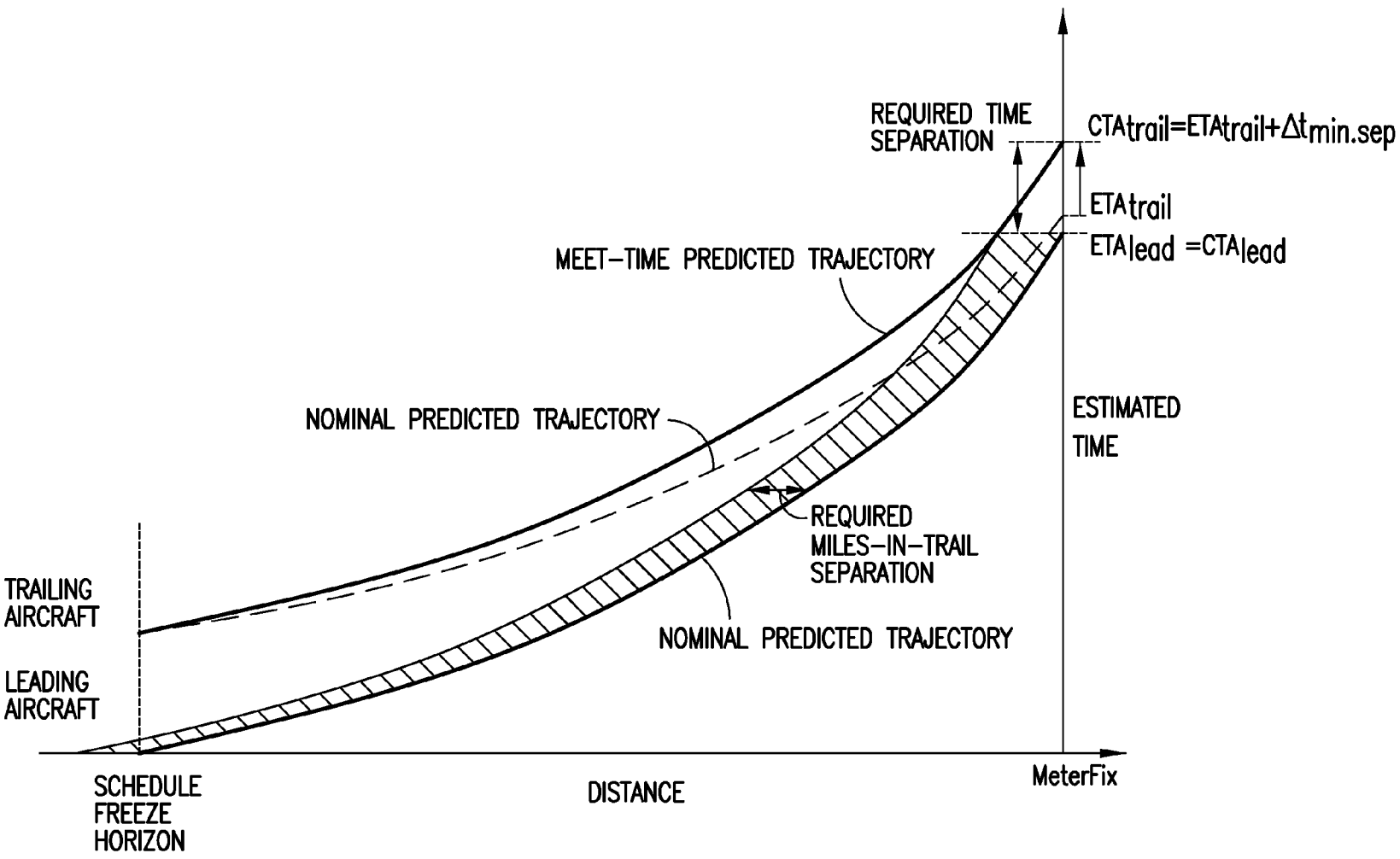
FIG. 3 is a predicted time-distance diagram of a leading and trailing aircraft pair to a metering fix and the resulting scheduling action for a scheduling algorithm that sequences flights at a metering fix, based on their predicted trajectory, ensuring a minimum required separation either in distance or time.

FIG. 3 is a predicted time-distance diagram of a leading and trailing aircraft pair to a metering fix and the resulting scheduling action for an existing scheduling algorithm that sequences flights at the metering fix, based on their predicted trajectory, ensuring a minimum required separation either in distance (for example, wake vortex criteria) or time (for example, to adopt a desired throughput rate). The lower bold solid curved line represents the nominal predicted trajectory of the leading aircraft predicted to arrive at the metering fix at time $ETA_{lead}$. The dashed curved line represents the nominal predicted trajectory of the trailing aircraft predicted to arrive at the metering fix at time $ETA_{trail}$. The ETAs are computed based on the aircraft times of arrival at the schedule freeze horizon. The upper bold solid curved line represents the meet-time predicted trajectory of the trailing aircraft. The hatched area indicates the required miles-in-trail separation as the leading aircraft approaches the metering fix. The vertical two-headed arrow indicates the required time separation between the respective times of arrival of the leading and trailing aircraft at the metering fix. In the example depicted, the ETA and CTA of the leading aircraft are equal (i.e., $ETA_{lead}=CTA_{lead}$), while the CTA of the trailing aircraft is equal to the sum of the ETA of the trailing aircraft and the required time of separation $\Delta t_{min.sep}$ (i.e., $CTA_{trail}=ETA_{trail}+\Delta t_{min.sep}$).

Figure 6:
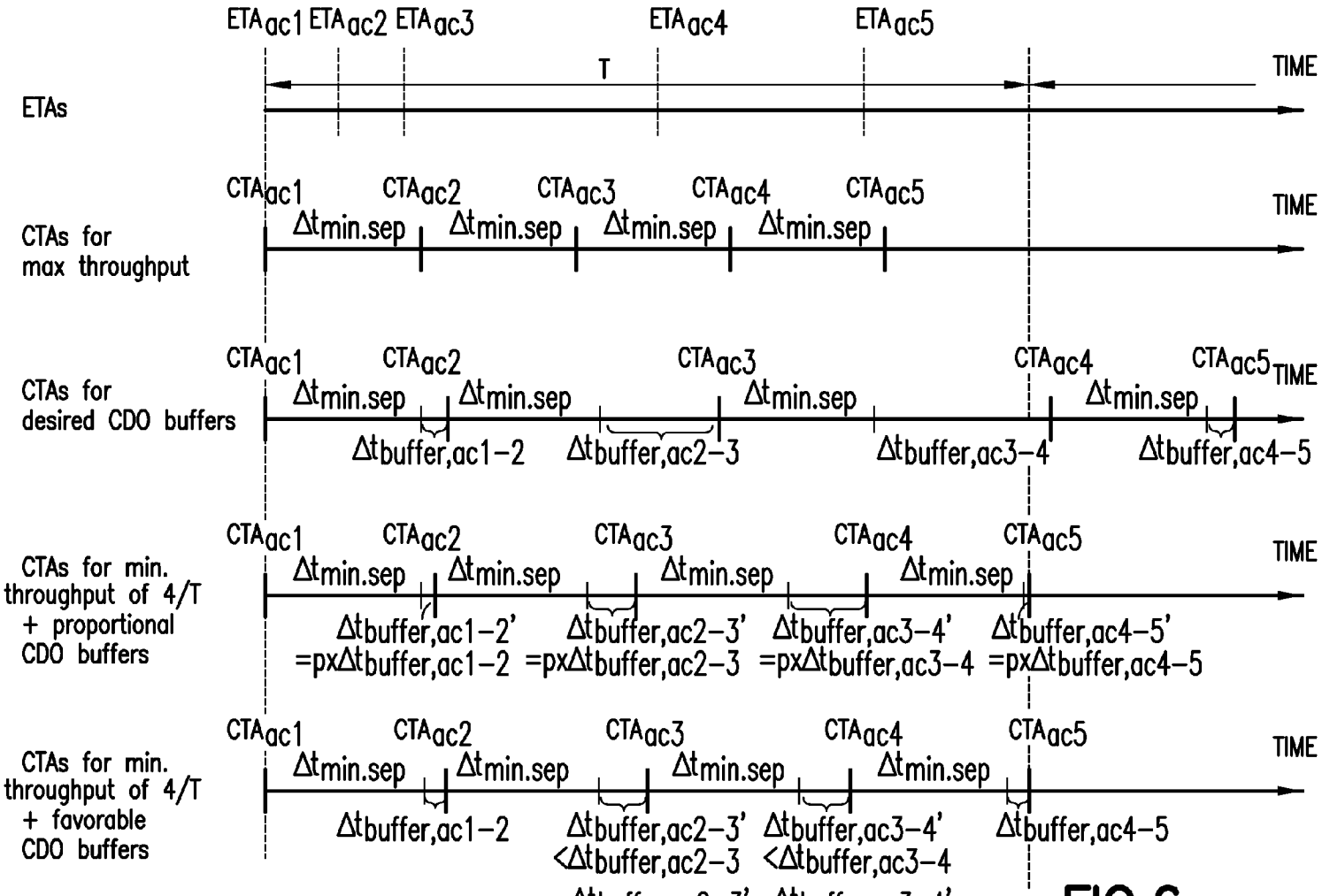
FIG. 6 is a diagram comprising a set of timelines for a sample scheduling process for an arrival demand of N=5 aircraft over a time span T and a set minimum required throughput of M=4 aircraft per time span T. The five aircraft are respectively designated as ac1 through ac5.

FIG. 6 is a diagram comprising a set of timelines for a sample scheduling process for an arrival demand of N=5 aircraft over a time span T and a set minimum required throughput of M=4 aircraft per time span T. The five aircraft are respectively designated as ac1 through ac5. The first timeline in FIG. 6 indicates the ETAs for five aircraft (i.e., $ETA_{ac1}$, $ETA_{ac2}$, $ETA_{ac3}$, $ETA_{ac4}$, and $ETA_{ac5}$). The second timeline in FIG. 6 indicates the corresponding CTAs for the same aircraft (i.e., $CTA_{ac1}$, $CTA_{ac2}$, $CTA_{ac3}$, $CTA_{ac4}$, and $CTA_{ac5}$) when the existing scheduling algorithm sequences flights at the metering fix to ensure a minimum required separation in time $\Delta t_{min.sep}$ and maximum throughput. (Alternatively, the minimum required separation can be expressed in terms of distance.) A similar sketch can be made to cover the sequencing at the runway threshold. Note that the alignment between the schedule at the runway(s) and at the metering fix(es) involves more complexity not essential to understanding or enabling the subject matter recited in the appended claims.

Figure 4:
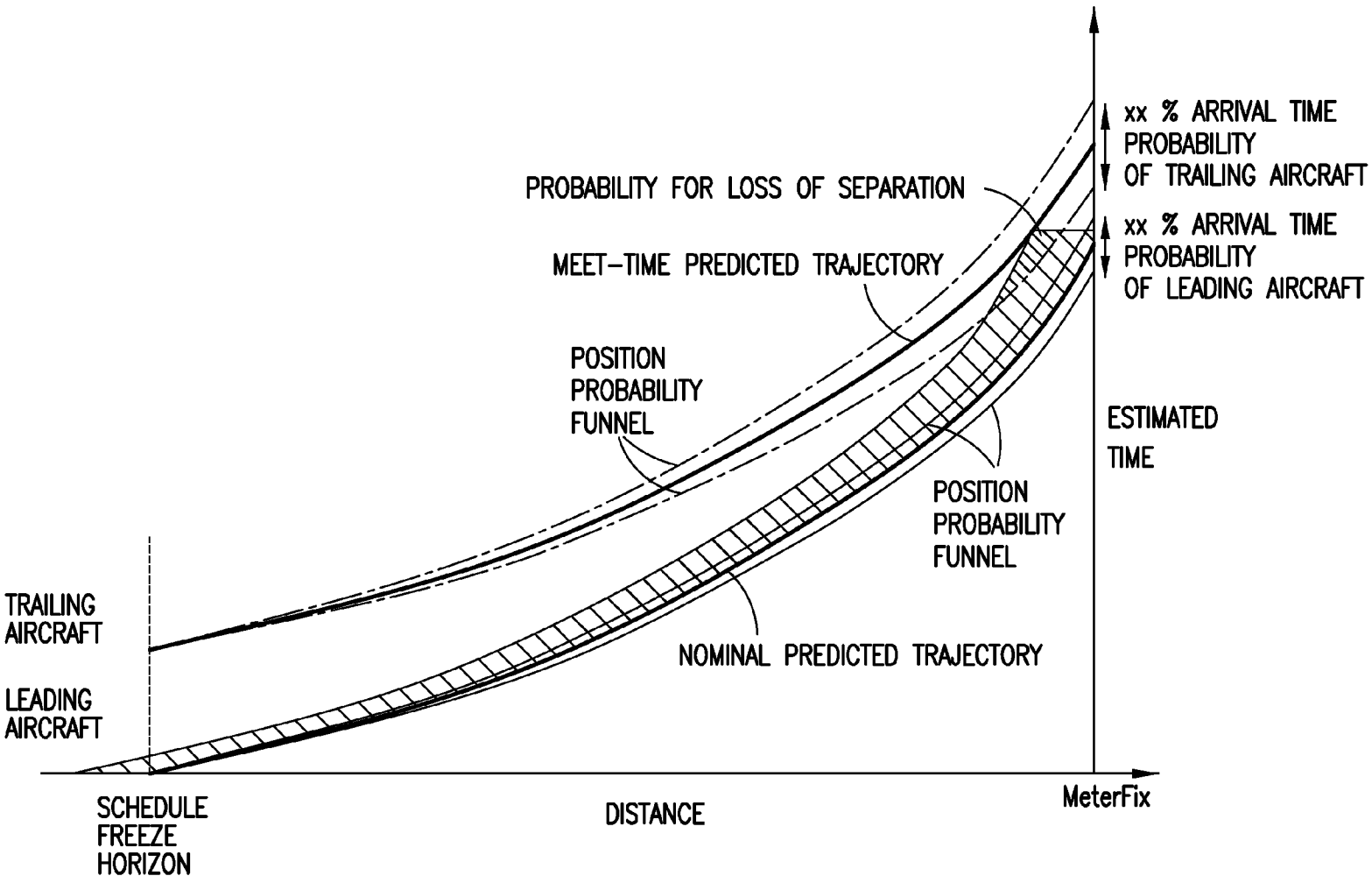
FIG. 4 is a predicted time-distance diagram of a leading and trailing aircraft pair to a metering fix and the associated probability funnel depending on the level of uncertainty and FMS guidance method.

In reality, aircraft will not fly the predicted (planned) trajectory perfectly due to the presence of uncertainty as explained above. FIG. 4 sketches sample uncertainty funnels of the aircraft position along the planned trajectories (i.e., the guidance reference). The lower bold solid curved line in FIG. 4 represents the nominal predicted trajectory of the leading aircraft, while the pair of thin solid curved lines equally spaced from the nominal predicted trajectory of the leading aircraft represent the associated position probability funnel. The upper bold solid curved line represents the meet-time predicted trajectory of the trailing aircraft, while the pair of dashed curved lines (i.e., with alternating short dashes and long dashes) equally spaced from the meet-time predicted trajectory of the trailing aircraft represent the associated position probability funnel. The vertical two-headed arrows adjacent the vertical axis indicate the respective arrival time probabilities of the leading and trailing aircraft. The hatched area again indicates the required miles-in-trail separation as the leading aircraft approaches the metering fix along its nominal predicted trajectory.

As seen in the scenario depicted in FIG. 4, the hatched area representing the required miles-in-trail separation overlaps with the position probability funnel of the trailing aircraft, which overlap is indicated by more closely spaced hatching in the blade-shaped area labeled "PROBABILITY FOR LOSS OF SEPARATION". The probability that a loss of separation between the leading and trailing aircraft will occur is proportional to the area of the overlap. The larger the overlap of the time confinement funnels of the trailing flights, the higher the probability for tactical intervention on at least one of the flights in order to maintain safe spacing. The shape of the position probability funnel will depend primarily on the applied FMS guidance technique (non-4-D guidance, RTA or other 4-D guidance methods, FIM, etc.), and secondly on the level of trajectory uncertainty.

Figure 5:
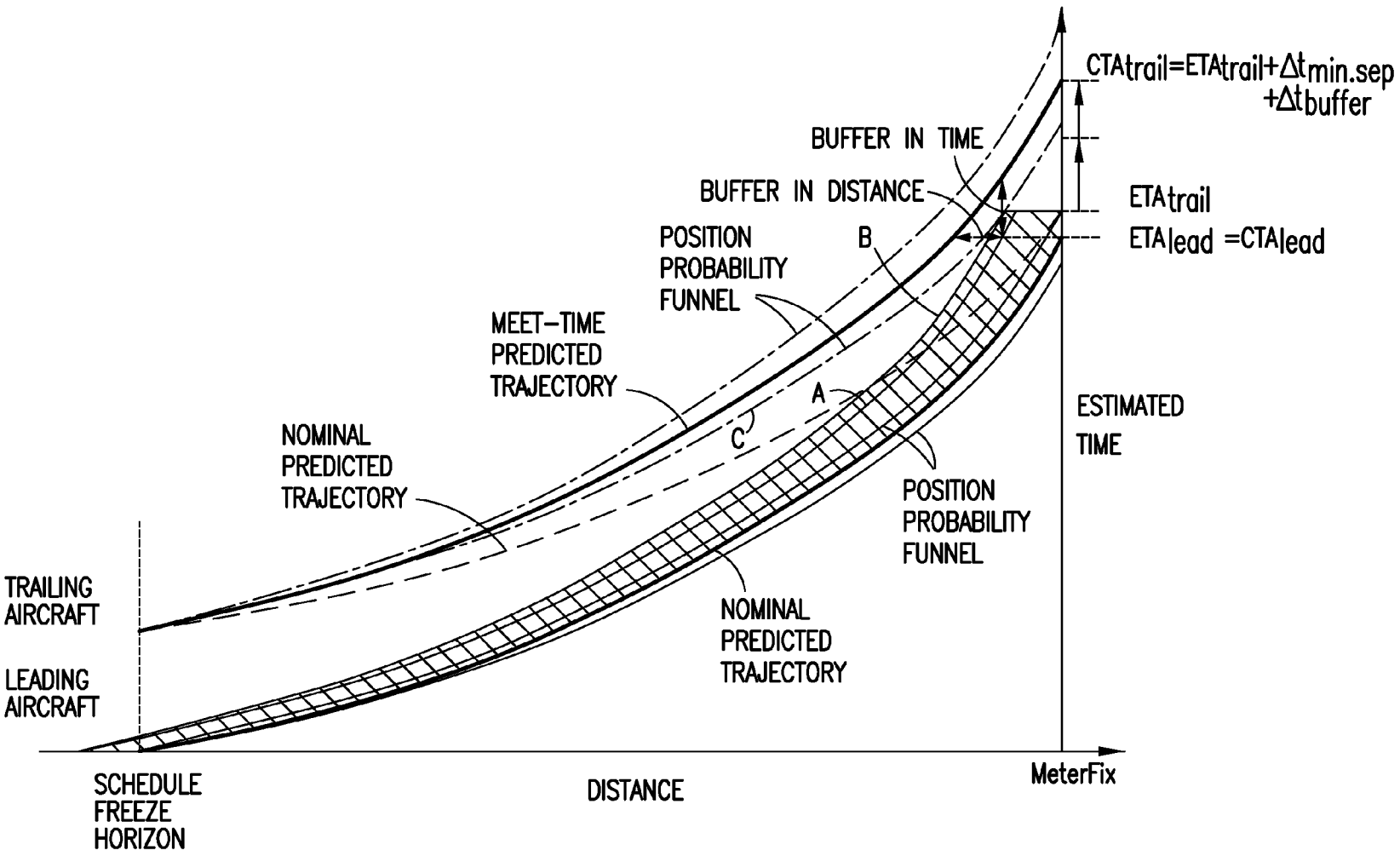
FIG. 5 is a predicted time-distance diagram of a leading and trailing aircraft pair to a metering fix and the resulting scheduling action with buffers taking into account the delivery accuracy of the FMS guidance method in the presence of a level of uncertainty.

To reduce the probability of tactical intervention during continuous descent operations, a spacing buffer $\Delta t_{buffer}$ can be added on top of the minimum separation requirement $\Delta t_{min.sep}$ as outlined in FIG. 5. The lower bold solid curved line represents the nominal predicted trajectory of the leading aircraft predicted to arrive at the metering fix at time $ETA_{lead}$. The pair of thin solid curved lines equally spaced from the nominal predicted trajectory of the leading aircraft represent the associated position probability funnel. The dashed curved line represents the nominal predicted trajectory of the trailing aircraft predicted to arrive at the metering fix at time $ETA_{trail}$. The upper bold solid curved line represents the meet-time predicted trajectory of the trailing aircraft controlled to arrive at the metering fix at time $CTA_{trail}$. In the example depicted in FIG. 5, the ETA and CTA of the leading aircraft are equal (i.e., $ETA_{lead}=CTA_{lead}$), while the CTA of the trailing aircraft is equal to the sum of the ETA of the trailing aircraft, the required time of separation $\Delta t_{min.sep}$, and the spacing buffer $\Delta t_{buffer}$ (i.e., $CTA_{trail}=ETA_{trail}+\Delta t_{min.sep}+\Delta t_{buffer}$, where $\Delta t_{min.sep}$ and $\Delta t_{buffer}$ and indicated by the stacked vertical arrows to the right of the vertical "ESTIMATED TIME" axis in FIG. 5). The ETAs are computed based on the aircraft times of arrival at the schedule freeze horizon. The pair of dashed curved lines (i.e., with alternating short dashes and long dashes) equally spaced from the meet-time predicted trajectory of the trailing aircraft represent the associated position probability funnel. The hatched area indicates the required miles-in-trail separation as the leading aircraft approaches the metering fix.

To avoid clutter in FIG. 5, the final two thin solid curved lines to be described have been respectively labeled A and B. Line A represents a trajectory equal to the nominal predicted trajectory of the leading aircraft plus a minimum separation offset (corresponding to $\Delta t_{min.sep}$). Line B represents a trajectory equal to the nominal predicted trajectory plus its position probability funnel plus the minimum separation offset. So the difference between lines A and B should equal the size of the position probability funnel (one side of it as seen in FIG. 5) of the leading aircraft.

The scheduling methodology disclosed herein can be adapted to prevent overlap of line B, representing a trajectory of the leading aircraft, with the position probability funnel of the trailing aircraft. The start of such overlap would be indicated by the intersection of line B with the right-hand boundary of the position probability funnel for the trailing aircraft, labeled C in FIG. 5. The extra spacing buffers (time and distance) are represented in FIG. 5 by the vertical and horizontal two-headed arrows, which represent the time difference and the separation distance between the meet-time predicted trajectory of the trailing aircraft and the trajectory represented by line C. In other words, spacing buffer $\Delta t_{buffer}$ is a function of (and may correspond to) the sum of the size of the probability funnel of the leading aircraft and the size of the probability funnel of the trailing aircraft.

As compared to FIG. 4, the hatched region indicating the required separation has expanded leftward in FIG. 5 due to the added spacing buffer. The size of the spacing buffer $\Delta t_{buffer}$ should depend on the size of the delivery accuracy probability of the leading and trailing aircraft at the metering fix (and similarly at the runway) and the desired probability to avoid ATC intervention. For example, the spacing buffer between two aircraft equipped with 4-D guidance may be only a few seconds whereas the buffer between aircraft not equipped with 4-D guidance may be a few tens of seconds to achieve the same probability of success.

On the other hand, the size of the spacing buffers should be capped to accommodate a minimum desired arrival throughput. In the end airport capacity is more important for many airports than optimal fuel efficiency. Setting a minimum throughput should limit accumulating arrival delay in peak traffic hours. As arrival traffic demand fluctuates over the day, ideally the minimum throughput should be a dynamic value that takes into account the expected arrival demand around a given time-of-the-day. During periods of low demand the minimum desired arrival throughput could be reduced to allow for larger spacing buffers and hence a higher probability of CDO success.

The ideal spacing buffers can be estimated off-line with high-fidelity simulations and recorded operational data. The relationship between the amount of spacing buffer and probability of uninterrupted CDO needs to be determined per aircraft sequence pair, covering all combinations of available FMS guidance techniques, for a given airport. Optionally one could also consider other flight properties besides FMS guidance technique that have a relevant influence on the delivery accuracy.

Using such tables, the core scheduling process or algorithm can be described as follows:

(1) First, the algorithm sequences the arriving traffic with the appropriate buffers $\Delta t_{buffer,ac1\text{-}2}$, $\Delta t_{buffer,ac2\text{-}3}$, etc. for a given desired CDO success rate as sketched in the third timeline of FIG. 6. A 100% success rate would be ideal, but in reality this is not practical. Optionally, the air navigation service provider could opt to allow a higher CDO success probability for aircraft equipped with more advanced guidance methods as an incentive for airlines to invest in upgrading their fleets.

(2) Next, if necessary, the scheduling algorithm reduces the obtained inter-arrival spacing buffers to accommodate a given desired throughput rate and optionally a maximum (average) delay time over a certain time span T. The reduction of spacing buffers can be applied in two manners:

(a) Distribute the reduction proportionally over all applied spacing buffers $\Delta t_{buffer,ac1\text{-}2}'$, $\Delta t_{buffer,ac2\text{-}3}'$, etc. as outlined in the fourth timeline of FIG. 6, where $\Delta t_{buffer,ac1\text{-}2}'=p\times\Delta t_{buffer,ac1\text{-}2}$ etc. The proportion p of the buffer reduction can be calculated using the following equation:

$$p = \max\left(\frac{CTA_{ac(N+1)} - (CTA_{ac1} + T)}{\sum_{t=1}^{N} \Delta t_{buffer,ac(i)-(i+1)}}, 0\right)$$

where N is the desired number of aircraft per time span T.

(b) Favor aircraft with the smallest spacing buffers, i.e., the more advanced FMSs, by first reducing the largest buffers in the queue as illustrated in the last timeline of FIG. 6. In this example, the spacing buffers between ac2-3 and ac3-4 are reduced to an equal duration $\Delta t_{buffer,ac2\text{-}3}'=\Delta t_{buffer,ac3\text{-}4}'$. This will be an iterative loop by equally reducing the largest spacing buffer(s) up to the size (i.e., duration) of the second largest buffer and so on until the target throughput rate is achieved. As a result, flights with lower 4-D guidance performance will be penalized with a higher probability of requiring tactical intervention by ATC. Again this could be an incentive for airlines to upgrade their aircraft equipage. In case the spacing buffers of all flight pairs have been reduced to the same size but the desired throughput rate is not yet achieved, the remaining buffer times can be further reduced proportionally for all flights. The difference with method (a) above is that all flights start with the same remaining buffer size when determining the proportional reduction. Hence aircraft with more advanced equipage capabilities will still be favored with a higher probability of flying an uninterrupted continuous descent.

Similarly, buffers can be reduced until the (average) delay time is reduced to a set requirement.

Figure 7:
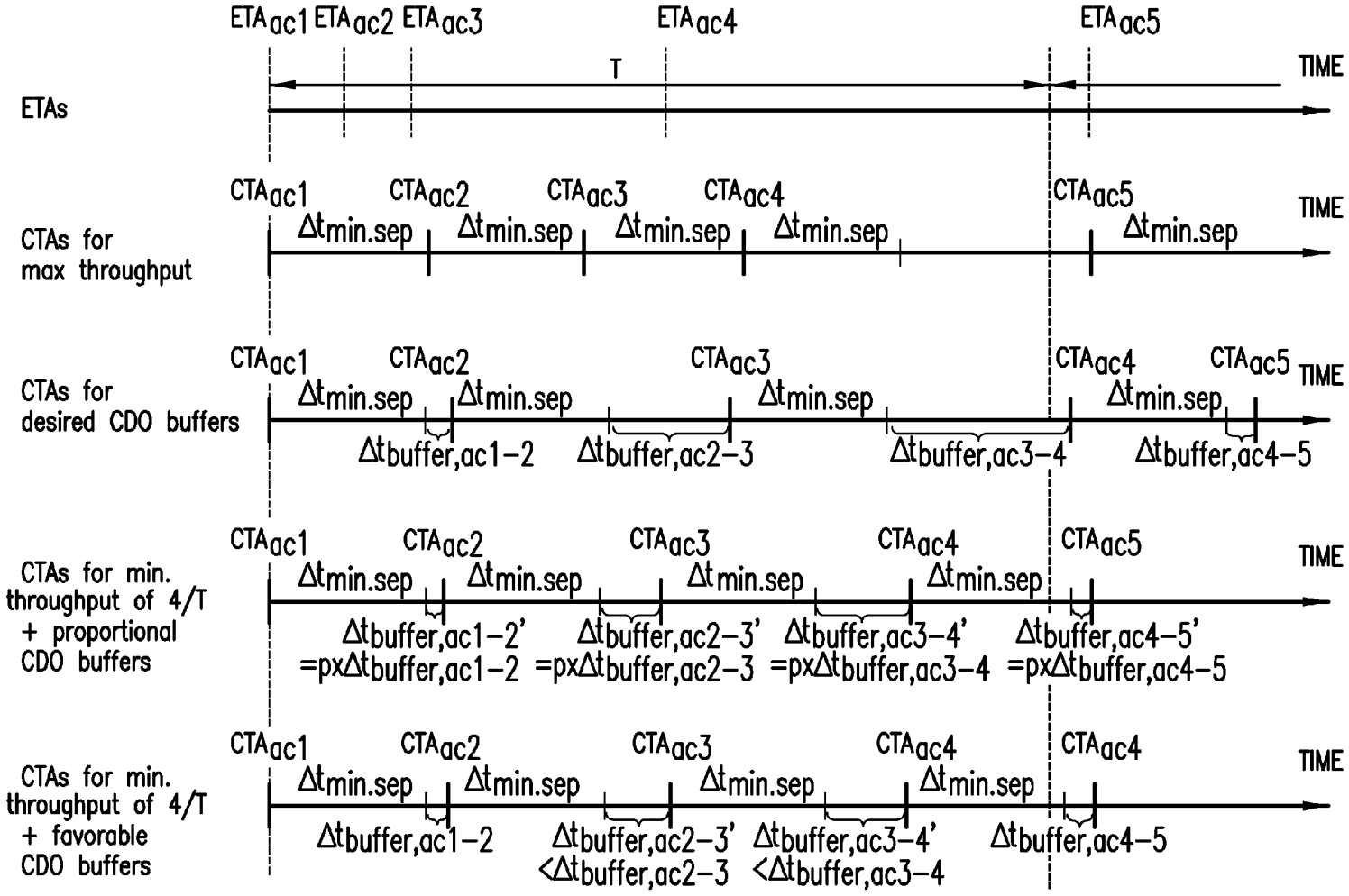
FIG. 7 is a diagram comprising a set of timelines for a sample scheduling process for an arrival demand of N=4 aircraft over a time span T and a set minimum required throughput of M=4 aircraft per time span T.

FIG. 7 shows a situation in which the traffic demand over a time span T equals the minimum throughput rate. More specifically, a set of timelines are presented for a sample scheduling process for an arrival demand of N=4 aircraft over a time span T and a set minimum required throughput of M=4 aircraft per time span T. In this case, the reduction in spacing buffers can be more relaxed and depends on the expected arrival time of the first flight after the current time span.

In FIG. 7, five aircraft are again respectively designated as ac1 through ac5. The first timeline in FIG. 7 indicates the ETAs for five aircraft (i.e., $ETA_{ac1}$, $ETA_{ac2}$, $ETA_{ac3}$, $ETA_{ac4}$, and $ETA_{ac5}$). The second timeline in FIG. 7 indicates the corresponding CTAs for the same aircraft (i.e., $CTA_{ac1}$, $CTA_{ac2}$, $CTA_{ac3}$, $CTA_{ac4}$, and $CTA_{ac5}$) when the existing scheduling algorithm sequences flights at the metering fix to ensure a minimum required separation in time $\Delta t_{min.sep}$ and maximum throughput. (Alternatively, the minimum required separation can be expressed in terms of distance.) A similar sketch can be made to cover the sequencing at the runway threshold.

In accordance with one application of the enhanced scheduling methodology disclosed herein, first the enhanced scheduling algorithm sequences the arriving traffic with appropriate buffers $\Delta t_{buffer,ac1\text{-}2}$, $\Delta t_{buffer,ac2\text{-}3}$, etc. for a given desired CDO success rate as sketched in the third timeline of FIG. 7. Next, if necessary, the algorithm reduces the obtained inter-arrival spacing buffers to accommodate a given desired throughput rate and optionally a maximum (e.g., average) delay time over a time span T. The reductions in the durations of the spacing buffers can be applied in two ways: (a) by distributing the reductions proportionally over all applied spacing buffers $\Delta t_{buffer,ac1\text{-}2}'$, $\Delta t_{buffer,ac2\text{-}3}'$, etc. as outlined in the fourth timeline of FIG. 7, where $\Delta t_{buffer,ac1\text{-}2}'=p\times\Delta t_{buffer,ac1\text{-}2}$ etc.; or (b) favor aircraft with the smallest spacing buffers by first reducing the largest buffers in the queue as illustrated in the last timeline of FIG. 7. In this example, the spacing buffers between ac2-3 and ac3-4 are reduced to an equal duration $\Delta t_{buffer,ac2\text{-}3}'=\Delta t_{buffer,ac3\text{-}4}'$.

Figure 8:
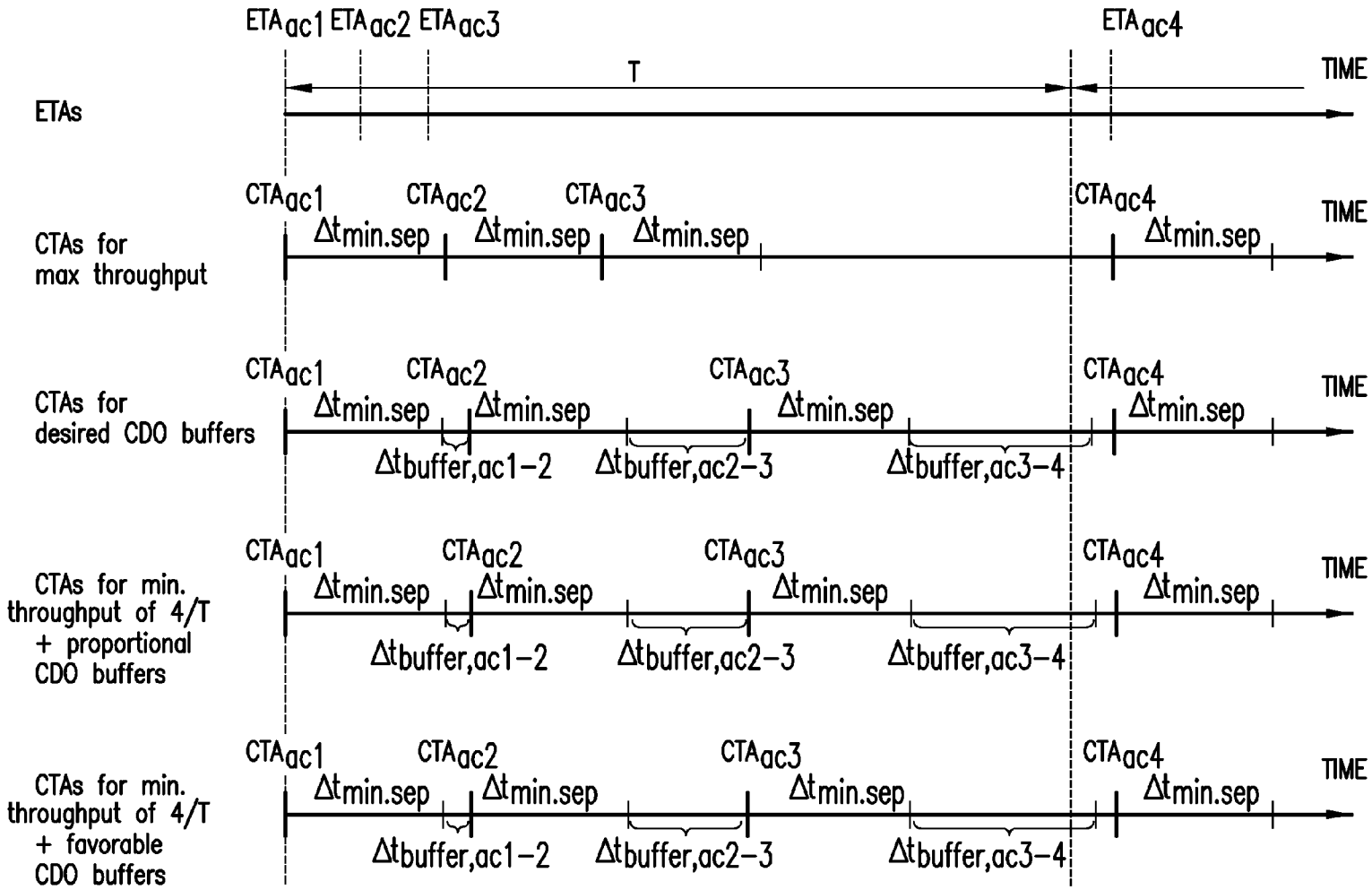
FIG. 8 is a diagram comprising a set of timelines for a sample scheduling process for an arrival demand of N=3 aircraft over a time span T and a set minimum required throughput of M=4 aircraft per time span T. The four aircraft are respectively designated as ac1 through ac4.

If a minimum throughput rate was specified that exceeds the actual traffic demand over time span T, no downsizing of the buffers would be required, as illustrated in FIG. 8. More specifically, a set of timelines are presented for a sample scheduling process for an arrival demand of N=3 aircraft over a time span T and a set minimum required throughput of M=4 aircraft per time span T.

In FIG. 8, four aircraft are respectively designated as ac1 through ac4. The first timeline in FIG. 8 indicates the ETAs for the four aircraft (i.e., $ETA_{ac1}$, $ETA_{ac2}$, $ETA_{ac3}$, and $ETA_{ac4}$). The second timeline in FIG. 8 indicates the corresponding CTAs for the same aircraft (i.e., $CTA_{ac1}$, $CTA_{ac2}$, $CTA_{ac3}$, and $CTA_{ac4}$) when the existing scheduling algorithm sequences flights at the metering fix to ensure a minimum required separation in time At and maximum throughput.

In accordance with another application of the enhanced scheduling methodology disclosed herein, the enhanced scheduling algorithm again sequences the arriving traffic with appropriate buffers $\Delta t_{buffer,ac1\text{-}2}$, $\Delta t_{buffer,ac2\text{-}3}$, etc. in accordance with the arrival demand as sketched in the third timeline of FIG. 8. However, because a minimum throughput rate was specified that exceeded the actual traffic demand over the time span T, the buffers will not be downsized, as illustrated by the fourth and last timelines in FIG. 8, which are the same as the third timeline.

In the two cases presented in FIGS. 6 and 7, the proportion p of the buffer reduction can be calculated using the following equation:

$$p = \max\left(\frac{CTA_{ac(N+1)} - ETA_{ac(N+1)}}{\sum_{t=1}^{N} \Delta t_{buffer,ac(i)-(i+1)}}, 0\right)$$

where N is the desired number of aircraft per time span T.

As demand fluctuates over time, the above core scheduling process needs be repeated per subsequent time span T. Optionally, it can be considered to apply a partial overlap of the subsequent time spans in order to get a smooth sizing of the buffers over time. Also in case the minimum throughput requirement is desired to change in time, executing the scheduling process with overlapping time span batches T is likely beneficial.

By introducing equipage-dependent spacing buffers on top of the minimum separation criteria in the scheduling process, one can maximize the probability of completing uninterrupted CDOs irrespective of the equipage mix while maintaining a desired arrival throughput.

The existing arrival management systems only schedule flights to maximize arrival throughput taking into account user-specified throughput targets, wake vortex criteria and other separation requirements. The system disclosed above is designed to also take advantage of the characteristics of the expected traffic mix with different onboard flight guidance equipage in order to maximize fuel efficiency and reduce environmental impact. The disclosed scheduling process loosens the inter-arrival spacing in order to reduce the number of tactical interventions by air traffic control. This maximizes the probability for more efficient descents. Simulation results showed that delaying flights strategically up to some extent with speed reduction does not penalize fuel consumption, but rather saves some fuel. In addition by making the extra spacing a function of the expected delivery performance of the various aircraft guidance technologies, the probability for success can be optimized as long as traffic demand allows.

While systems for generating arrival traffic schedules incorporating equipage-dependent in-trail spacing have been described with reference to various embodiments, it will be understood by those skilled in the art that various changes may be made and equivalents may be substituted for elements thereof without departing from the scope of the claims set forth hereinafter. In addition, many modifications may be made to adapt the teachings herein to a particular situation without departing from the scope of the claims.

As used in the claims, the term "computer system" should be construed broadly to encompass a system having at least one computer or processor, and which may have multiple computers or processors that communicate through a network or bus. As used in the preceding sentence, the terms "computer" and "processor" both refer to devices having a processing unit (e.g., a central processing unit) and some form of memory (i.e., computer-readable medium) for storing a program which is readable by the processing unit.

The method claims set forth hereinafter should not be construed to require that the steps recited therein be performed in alphabetical order or in the order in which they are recited. Nor should they be construed to exclude any portions of two or more steps being performed concurrently or alternatingly.

The invention claimed is:

1. A method for scheduling arrivals of aircraft at a fixed position, comprising:

obtaining first and second controlled times of arrival for first and second aircraft approaching the fixed position, said first and second controlled times of arrival being separated by a separation time;

calculating a first spacing buffer time which is dependent on which guidance methods are being executed by respective flight management systems onboard the first and second aircraft;

calculating an updated second controlled time of arrival for the second aircraft, wherein the updated second controlled time of arrival is calculated by adding said separation time and said first spacing buffer time to said first controlled time of arrival; and controlling the second aircraft so that it will arrive at the fixed position at a time which differs from said updated second controlled time of arrival by less than a specified tolerance.

2. The method as recited in claim 1, further comprising transmitting an instruction to the second aircraft that includes said updated second controlled time of arrival.

3. The method as recited in claim 1, wherein the fixed position is a metering fix.

4. The method as recited in claim 1, wherein the fixed position is a runway threshold.

5. The method as recited in claim 1, further comprising:

obtaining a third controlled time of arrival for a third aircraft approaching the fixed position, said third controlled time of arrival being separated from said second controlled time of arrival by said separation time;

calculating a second spacing buffer time which is dependent on which guidance methods are being executed by respective flight management systems onboard the second and third aircraft;

calculating an updated third controlled time of arrival for the third aircraft, wherein said updated third controlled time of arrival is calculated by adding said separation time and said second spacing buffer time to said updated second controlled time of arrival; and controlling the third aircraft so that it will arrive at the fixed position at a time which differs from said updated third controlled time of arrival by less than said specified tolerance.

6. A method for scheduling arrivals of aircraft at a fixed position, comprising:

obtaining first, second and third controlled times of arrival for first, second and third aircraft approaching the fixed position, said first and second controlled times of arrival being separated by a separation time, and said second and third controlled times of arrival being separated by said separation time;

calculating a first spacing buffer time which is dependent on which guidance methods are being executed by respective flight management systems onboard the first and second aircraft;

calculating an updated second controlled time of arrival for the second aircraft, wherein said updated second controlled time of arrival is calculated by adding said separation time and said first spacing buffer time to said first controlled time of arrival;

controlling the second aircraft so that it will arrive at the fixed position at a time which differs from said updated second controlled time of arrival by less than a specified tolerance;

calculating a second spacing buffer time which is dependent on which guidance methods are being executed by respective flight management systems onboard the second and third aircraft;

reducing said second spacing buffer time to produce a reduced second spacing buffer; and calculating an updated third controlled time of arrival for the third aircraft, wherein said updated third controlled time of arrival is calculated by adding said separation time and said reduced second spacing buffer time to said updated second controlled time of arrival; and controlling the third aircraft so that it will arrive at the fixed position at a time which differs from said updated third controlled time of arrival by less than said specified tolerance.

7. The method as recited in claim 6, wherein said first spacing buffer time is not reduced.

8. The method as recited in claim 7, wherein said reduced second spacing buffer time is equal in size to said first spacing buffer time.

9. The method as recited in claim 6, further comprising reducing said first spacing buffer time to produce a reduced first spacing buffer time, wherein said updated second controlled time of arrival is calculated by adding said separation time and said reduced first spacing buffer time to said first controlled time of arrival.

10. The method as recited in claim 9, wherein said first and second spacing buffer times are reduced by the same proportion.

11. The method as recited in claim 6, further comprising:

transmitting an instruction to the second aircraft that includes said updated second controlled time of arrival; and transmitting an instruction to the third aircraft that includes said updated third controlled time of arrival.

12. A system for scheduling arrivals of aircraft at a fixed position, comprising:

a first aircraft comprising a first flight management computer configured to execute a first navigation method during an approach to an airport;

a second aircraft comprising a second flight management computer configured to execute a second navigation method during an approach to the airport;

an antenna within communication distance of the first and second aircraft; and a computer system programmed to perform the following operations:

obtaining first and second controlled times of arrival for the first and second aircraft at the fixed position, said first and second controlled times of arrival being separated by a separation time;

calculating a first spacing buffer time which is dependent on said first and second guidance methods being respectively executed by said first and second flight management systems onboard the first and second aircraft;

calculating an updated second controlled time of arrival for the second aircraft, wherein said updated second controlled time of arrival is calculated by adding said separation time and said first spacing buffer time to said first controlled time of arrival; and causing said antenna to transmit a first instruction to the second aircraft that includes said updated second controlled time of arrival, wherein said second navigation method is configured to control the second aircraft so that it will arrive at the fixed position at a time which differs from said updated second controlled time of arrival by less than a specified tolerance in response to reception of said first instruction from said antenna.

13. The system as recited in claim 12, wherein the fixed position is a metering fix.

14. The system as recited in claim 12, wherein the fixed position is a runway threshold.

15. The system as recited in claim 12, further comprising a third aircraft comprising a third flight management computer configured to execute a third navigation method during an approach to the airport, the third aircraft being within communication distance of said antenna, wherein said computer system is further programmed to perform the following operations:

obtaining a third controlled time of arrival for the third aircraft at the fixed position, said third controlled time of arrival being separated from said second controlled time of arrival by said separation time;

calculating a second spacing buffer time which is dependent on said second and third guidance methods being respectively executed by said second and third flight management systems onboard the second and third aircraft;

calculating an updated third controlled time of arrival for the third aircraft, wherein said updated third controlled time of arrival is calculated by adding said separation time and said second spacing buffer time to said updated second controlled time of arrival; and causing said antenna to transmit a second instruction to the third aircraft that includes said updated third controlled time of arrival, wherein said third navigation method is configured to control the third aircraft so that it will arrive at the fixed position at a time which differs from said updated third controlled time of arrival by less than said specified tolerance in response to reception of said second instruction from said antenna.

16. A system for scheduling arrivals of aircraft at a fixed position, comprising:

a first aircraft comprising a first flight management computer configured to execute a first navigation method during an approach to an airport;

a second aircraft comprising a second flight management computer configured to execute a second navigation method during an approach to the airport;

a third aircraft comprising a third flight management computer configured to execute a third navigation method during an approach to the airport;

an antenna within communication distance of the first, second and third aircraft; and a computer system programmed to perform the following operations:

obtaining first, second and third controlled times of arrival for the first, second and third aircraft at the fixed position, said first and second controlled times of arrival being separated by a separation time, and said second and third controlled times of arrival being separated by said separation time;

calculating a first spacing buffer time which is dependent on said first and second guidance methods being respectively executed by said first and second flight management systems onboard the first and second aircraft;

calculating an updated second controlled time of arrival for the second aircraft, wherein the updated second controlled time of arrival is calculated by adding said separation time and said first spacing buffer time to said first controlled time of arrival;

causing said antenna to transmit a first instruction to the second aircraft that includes said updated second controlled time of arrival;

calculating a second spacing buffer time which is dependent on said second and third guidance methods being respectively executed by said second and third flight management systems onboard the second and third aircraft;

reducing said second spacing buffer time to produce a reduced second spacing buffer;

calculating an updated third controlled time of arrival for the third aircraft, wherein said updated third controlled time of arrival is calculated by adding said separation time and said reduced second spacing buffer time to said updated second controlled time of arrival; and causing said antenna to transmit a second instruction to the third aircraft that includes said updated third controlled time of arrival, wherein said second navigation method is configured to control the second aircraft so that it will arrive at the fixed position at a time which differs from said updated second controlled time of arrival by less than a specified tolerance in response to reception of said first instruction from said antenna, and said third navigation method is configured to control the third aircraft so that it will arrive at the fixed position at a time which differs from said updated third controlled time of arrival by less than said specified tolerance in response to reception of said second instruction from said antenna.

17. The system as recited in claim 16, wherein said first spacing buffer time is not reduced.

18. The system as recited in claim 17, wherein said reduced second spacing buffer time is equal in size to said first spacing buffer time.

19. The system as recited in claim 16, wherein said computer system is further programmed to reduce said first spacing buffer time to produce a reduced first spacing buffer time, wherein said updated second controlled time of arrival is calculated by adding said separation time and said reduced first spacing buffer time to said first controlled time of arrival.

20. The system as recited in claim 19, wherein said first and second spacing buffer times are reduced by the same proportion.

* * * * *